US008308037B2

(12) United States Patent
Muir et al.

(10) Patent No.: US 8,308,037 B2
(45) Date of Patent: Nov. 13, 2012

(54) PRINT MEDIA TENSIONING APPARATUS

(75) Inventors: Christopher M. Muir, Rochester, NY (US); Randy E. Armbruster, Rochester, NY (US); Ruth H. Parker, Webster, NY (US); Nathan J. Turner, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 321 days.

(21) Appl. No.: 12/627,003

(22) Filed: Nov. 30, 2009

(65) Prior Publication Data

US 2011/0129277 A1 Jun. 2, 2011

(51) Int. Cl.
*B65H 23/26* (2006.01)
*B65H 77/00* (2006.01)

(52) U.S. Cl. .... 226/194; 226/21; 226/196.1; 242/615.1; 242/615.2

(58) Field of Classification Search ..... 226/18–23, 226/174, 189, 194, 196.1; 242/548, 566, 242/615.1, 615.2, 615.21
See application file for complete search history.

(56) References Cited

U.S. PATENT DOCUMENTS

| | | | | | |
|---|---|---|---|---|---|
| 1,815,099 | A | * | 7/1931 | Foote | 198/808 |
| 2,066,306 | A | | 12/1936 | Horton | |
| 2,066,307 | A | * | 12/1936 | Horton | 242/615.1 |
| 2,797,091 | A | * | 6/1957 | Fife | 226/22 |
| 3,107,036 | A | * | 10/1963 | Richards et al. | 242/615.1 |
| 3,156,129 | A | * | 11/1964 | Greiner, Jr. | 474/104 |
| 3,300,114 | A | * | 1/1967 | Jacobsen | 226/180 |
| 3,373,288 | A | * | 3/1968 | Otepka et al. | 250/548 |
| 3,407,673 | A | * | 10/1968 | Slezak | 474/104 |
| 3,436,002 | A | * | 4/1969 | Racine | 226/23 |
| 3,583,615 | A | * | 6/1971 | Ott, Jr. | 226/20 |
| 3,966,105 | A | * | 6/1976 | Curran | 226/21 |
| 3,974,952 | A | | 8/1976 | Swanke et al. | |
| 4,069,959 | A | | 1/1978 | Bartell et al. | |
| 4,291,441 | A | * | 9/1981 | Bassani | 26/75 |
| 4,795,070 | A | | 1/1989 | Blanding et al. | |
| 4,893,740 | A | | 1/1990 | Hediger et al. | |
| 5,745,142 | A | | 4/1998 | Liston | |
| 5,906,305 | A | * | 5/1999 | Knorr | 226/21 |

FOREIGN PATENT DOCUMENTS

| | | | |
|---|---|---|---|
| EP | 0 092 735 | A2 | 11/1983 |
| EP | 1 798 050 | A1 | 6/2007 |
| WO | WO 2009/127888 | A2 | 10/2009 |

* cited by examiner

*Primary Examiner* — Sang Kim
*Assistant Examiner* — Scott Haugland
(74) *Attorney, Agent, or Firm* — William R. Zimmerli

(57) ABSTRACT

An apparatus for maintaining uniform tension across a width of a web includes a roller, a first arm and a second arm, a plurality of devices, and a plurality of links. The roller includes a shaft, about which the roller rotates, that defines an axis of rotation. The first arm and the second arm are coupled to opposite sides of the shaft of the roller and to a corresponding one of the plurality of devices such that each device is allowed two degrees of rotational freedom about the arm to which it is coupled. Each of the devices is pivotably coupled to a corresponding one of the plurality of links such that the roller is allowed to pivot about a first axis. Each link is pivotably coupled to a stationary frame such that the roller is allowed to pivot about a second axis.

20 Claims, 10 Drawing Sheets

PRINT MEDIA TENSIONING APPARATUS

CROSS REFERENCE TO RELATED APPLICATIONS

Reference is made to commonly-assigned copending U.S. patent application Ser. No. 12/627,018 filed Nov. 30, 2009 entitled "MEDIA TRANSPORT SYSTEM FOR NON-CONTACT PRINTING", by Muir et al.

FIELD OF THE INVENTION

This invention relates generally to the field of digitally controlled printing systems, and in particular to the media transport portion of these systems.

BACKGROUND OF THE INVENTION

In high speed inkjet printing systems, print media typically moves through the printing system as a continuous web of print media rather than individual sheets of print media. As the web of media passes through the print system, the print media is held under tension. Variations in the tension of the print media across the width of the print media cause the print media to drift laterally. Precision alignment of the rollers which support and guide the print media reduces the tendency of the print media to drift laterally, but achieving precision alignment of the rollers is, typically, a costly process. As precision alignment of the rollers can reduce or even eliminate drifting of the print media, conventional printing systems typically include servo-controlled web guides to steer the print media to the desired lateral position. While such web guides can be effective, they add significant cost to the printing system.

As such, there is an ongoing need to provide, at a relatively low cost, an apparatus that equalizes the tension of the print media across the width of the print media to reduce or even eliminate the tendency of the print media to drift laterally.

SUMMARY OF THE INVENTION

According to an aspect of the present invention, an apparatus for maintaining uniform tension across a width of a web is provided. The apparatus includes a roller, a first arm and a second arm, a plurality of devices, and a plurality of links. The roller includes a shaft about which the roller rotates. The shaft defines an axis of rotation. The first arm and second arm each include a first end. The first end of the first arm is rigidly coupled to an end of the shaft of the roller and extends away from the axis of rotation of the roller in a first direction. The shaft of the roller and the first arm lie in a plane. The first end of the second arm is rigidly coupled to an opposite end of the shaft of the roller. The shaft of the roller and the second arm lie in the plane. The second arm extends away from the axis of rotation of the roller in a second direction that is substantially opposite to the first direction. The first arm and the second arm each include a second end. The second end of each of the first arm and the second arm is coupled to a corresponding one of the plurality of devices. The location of coupling is at the same distance from the axis of rotation of the roller such that each device is allowed two degrees of rotational freedom about the arm to which it is coupled. The two degrees of rotational freedom lie within the plane. Each of the devices is pivotably coupled to a corresponding one of the plurality of links. Each link includes a first link and a second link. Each of the first link and the second link is pivotably coupled to the shaft of the roller at a first end through the device such that the roller is allowed to pivot about a first axis. Each of the first link and the second link is pivotably coupled to a stationary frame at a second end such that the roller is allowed to pivot about a second axis. The first axis and the second axis of the first link and the second link are substantially parallel to each other.

According to another aspect of the present invention, an apparatus for maintaining uniform tension across a width of a web is provided. The apparatus includes a roller, a first arm and a second arm, a plurality of devices, and a plurality of links. The roller includes a shaft, about which the roller rotates, that defines an axis of rotation. The first arm and the second arm are coupled to opposite sides of the shaft of the roller. The first arm and the second arm are coupled to a corresponding one of the plurality of devices. The location of the coupling is at the same distance from the axis of rotation of the roller such that each device is allowed two degrees of rotational freedom about the arm to which it is coupled. Each of the devices is pivotably coupled to a corresponding one of the plurality of links. Each link is pivotably coupled to the shaft of the roller through the device to which it is coupled such that the roller is allowed to pivot about a first axis. Each link is pivotably coupled to a stationary frame such that the roller is allowed to pivot about a second axis.

Additionally, the shaft of the roller, the first arm, and the second arm can be located relative to each other such that they lie in a plane. The first arm can also extend away from the axis of rotation of the roller in a first direction and the second arm can also extend away from the axis of rotation of the roller in a second direction that is substantially opposite to the first direction. The two degrees of rotational freedom about the arm to which each device is coupled can lie within the plane. The first axis and the second axis about which the roller is allowed to pivot can also be substantially parallel to each other.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Although the term "paper" is used in this application to refer to print media that is printed on by a printing system, the term "print media" should not be restricted to paper or paper based media. Instead, print media includes any media type that is printed on by the printing system, for example, those that include polymeric or metallic films or foils. Additionally, print media includes media types that include woven or non-woven structures.

Figure 1:
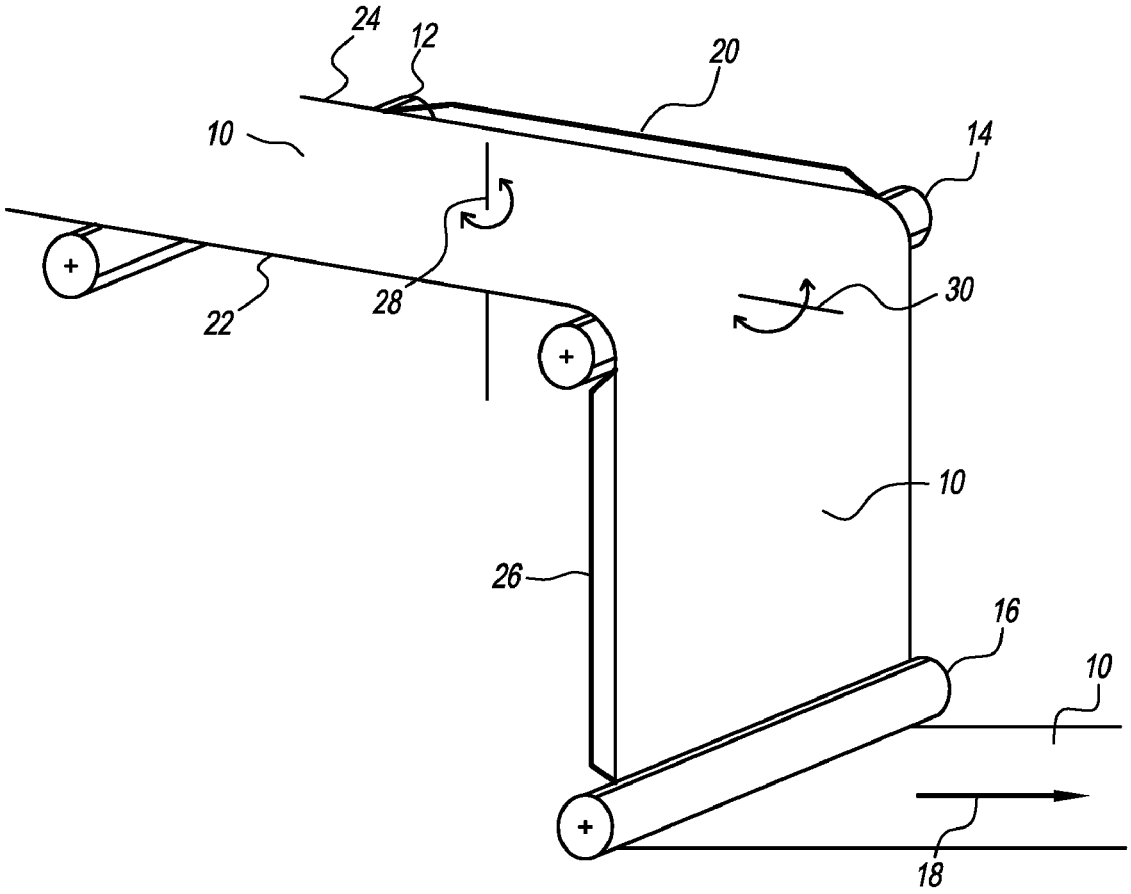
FIG. 1 is an isometric view of a roller guiding a print media web.

FIG. 1 shows a portion of a paper path for a web of print media 10 passing through a printing system, for example, one of the printing systems described in U.S. patent application Ser. No. 12/627,018 filed Nov. 30, 2009 entitled "MEDIA TRANSPORT SYSTEM FOR NON-CONTACT PRINTING", by Muir et al.

In FIG. 1, the print media 10 comes in from the left and passes over roller 12 and around rollers 14 and 16 before exiting to the right. The print media 10 wraps around a portion of the roller and exits from the bottom of the figure as indicated by the arrow 18. The print media 10 is under tension in the direction of paper motion. If the tension of the print media 10 isn't balanced across its width in the span 20, for example the tension is higher along the front edge 22 of the print media web than the back edge 24 of the print media web, the print media as it wraps around the roller 14 will tend to drift laterally in the direction of the front edge of the web. Similarly if the tension of the print media isn't balanced across its width in the span 26, for example the tension is higher along the front edge 22 of the print media web than the back edge 24 of the print media web, the print media as it wraps around the roller 16 will tend to drift laterally in the direction of the front edge of the web.

Allowing roller 14 to pivot about a caster axis 28 enables the tension to be balanced across the web in span 20. If roller 14 is also allowed to pivot around a gimbal axis 30, then the tension in the print media becomes balanced across the width of the web in the span 26. In this way, a castered and gimbaled roller balances the tension across the print media as it enters the roller and as it leaves the roller. The present invention provides a cost effective means to caster and gimbal a roller for use in a high speed printing system.

Figure 2:
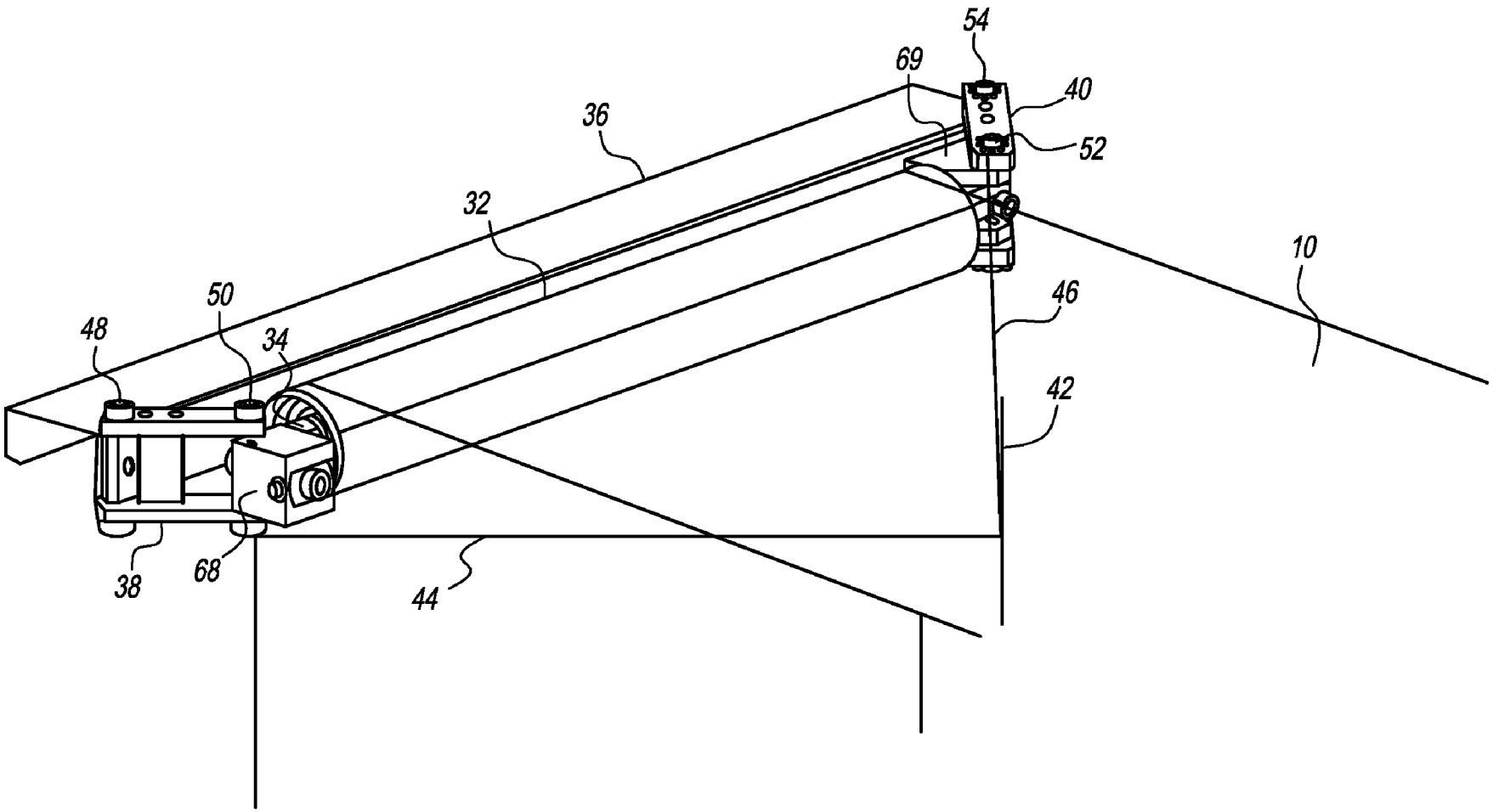
FIG. 2 is an isometric view of an example embodiment of the present invention showing the castered motion of the roller.
Figure 3:
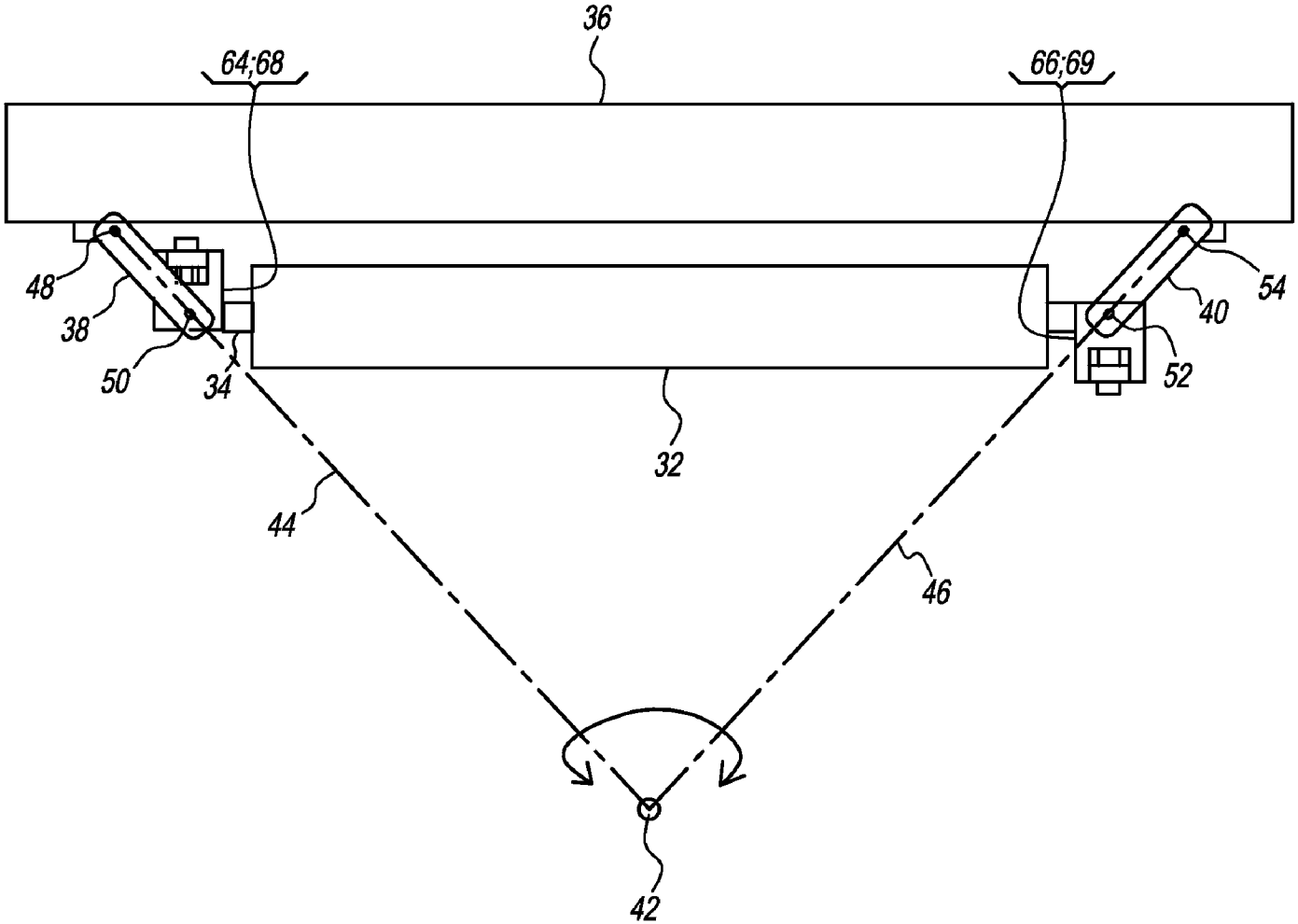
FIG. 3 is a top view of the example embodiment of the present invention shown in FIG. 2 showing the castered motion of the roller.

FIGS. 2 and 3 show an isometric and top view of an embodiment of the invention, respectively. As shown in FIG. 2, print media 10 approaches the roller 32 from the right (side of the figure), wraps around a portion of the roll and exit out the bottom. As drawn, FIG. 2 allows one to look through the print media in order to more easily see the roller and associated hardware. The roller 32, rotates around a shaft 34. The shaft is attached to the base 36 by means of linkage arms 38 and 40 and blocks 68 and 69. Linkage arm 38 is connected to the base 36 through pivot 48 and to block 68 by means of pivot 50. Linkage arm 40 is connected to the base 36 through pivot 54 and to block 69 by means of pivot 52. The rotation axes for each of the pivots are substantially parallel to each other. These linkage arms allow the roller 32 to pivot around a caster axis 42, which is parallel to the rotation axes of these four pivots. The caster axis is located approximately where the extension lines 44 and 46 that pass through the pivot points 48, 50, 52, and 54 of the linkage arms 38 and 40 intersect. The roller's caster axis must be located upstream of the roller, that is, it must be located on the side from which the paper approaches the roller.

Figure 4:
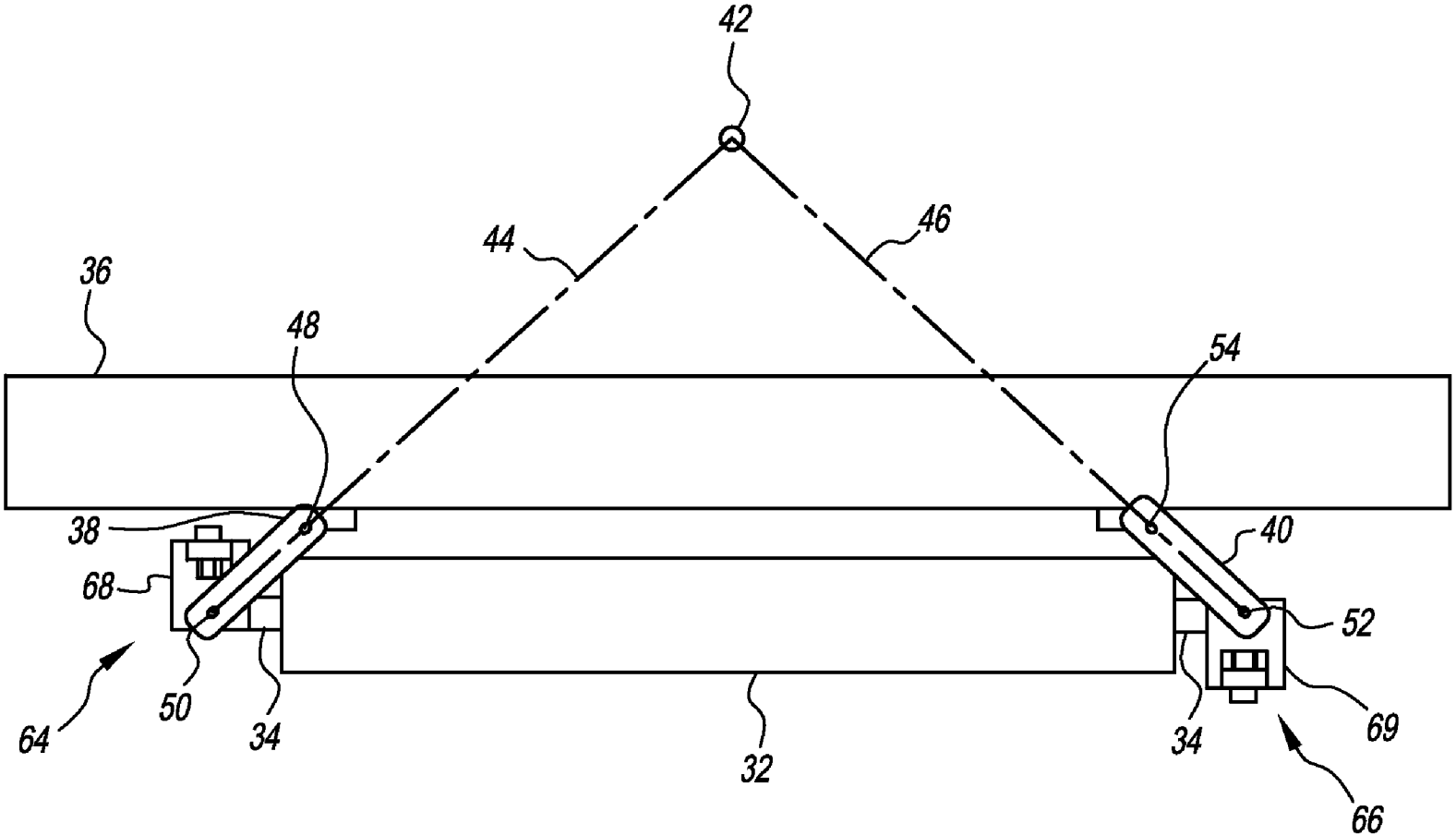
FIG. 4 is a top view of the example embodiment of the present invention shown in FIG. 3 showing an alternate position for the caster axis.

In FIG. 3, the linkage arms 38 and 40 diverge, which places the caster axis 42 on the opposite side of the roller 32 from the base 36. This is appropriate when the paper approaches the roller from the roller 32 side of the figure. FIG. 4 shows an embodiment with an alternate linkage arm orientation. The intersection of the extension lines 44 and 46, and the caster axis 42 are now on the same side of the roller as the base 36. This is appropriate when the paper approaches the roller 32 from the base 36 side of the figure. As shown in FIGS. 3 and 4, linkage arms 38 and 40 are symmetrically placed about the shaft 34 of the roller 32. In some embodiments of the invention, the ends of the linkage arms 38 and 40 that are pivotably coupled to the shaft of the roller include flexures.

Figure 5:
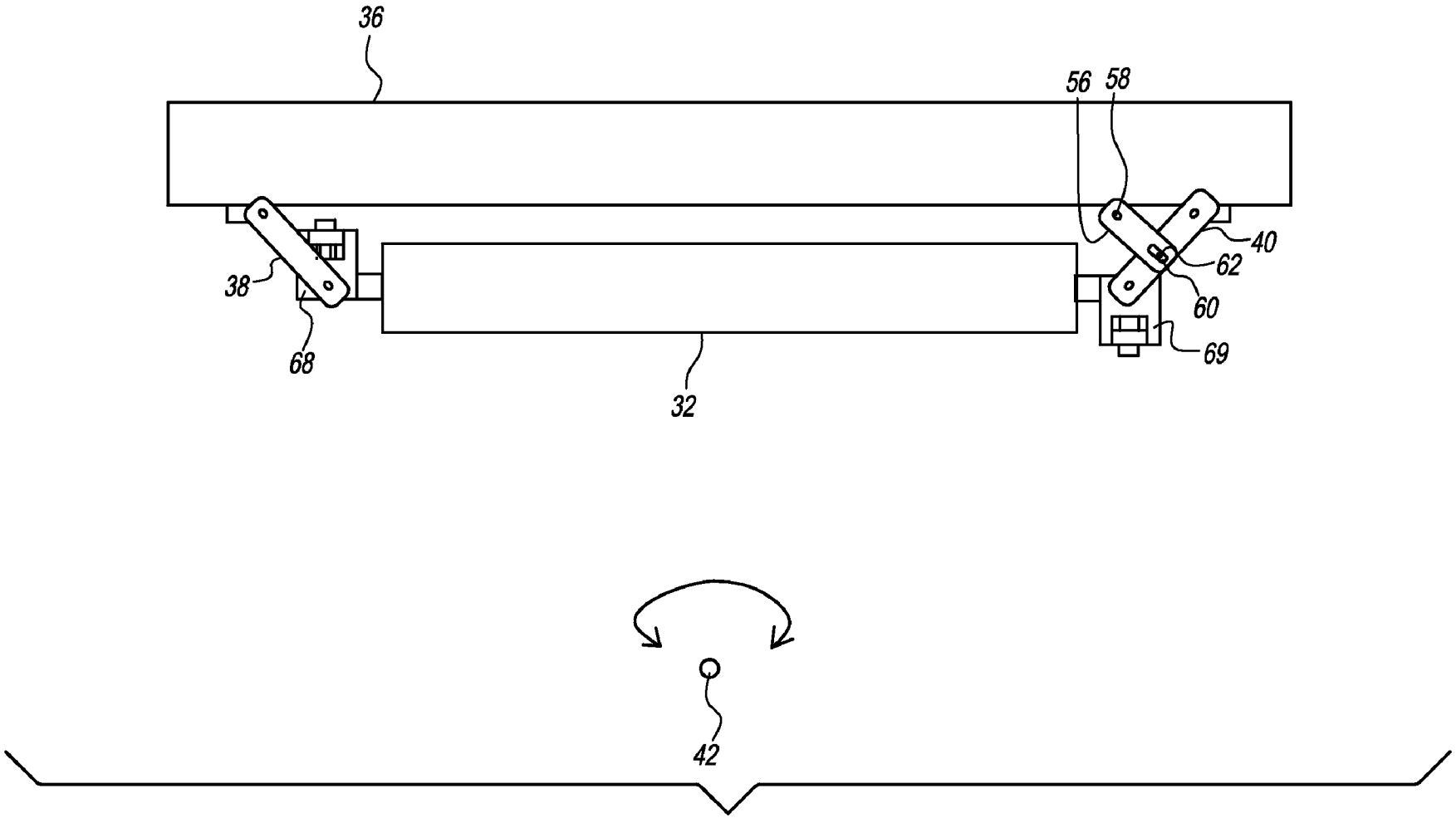
FIG. 5 is a top view of an example embodiment of the present invention in which the caster axis rotation is limited.

As there can be times when the print media can move in the reverse direction, and castered rollers are unstable when the print media motion is reversed, it is useful to limit the rotation of a castered roller about the caster axis. FIG. 5 shows an embodiment in which the amount of rotation of the roller about the caster axis has been limited by a linkage arm 56. The linkage arm 56 is attached to base 36 at pivot 58. The other end of the linkage arm 56 has a slot 60 in which a pin 62 that is mounted to linkage arm 40 can slide. The two ends of the slot limit the rotation of the roller about the caster axis 42.

As mentioned above, the roller shaft 34 is attached to the base 36 by means of the linkage arms 38 and 40. The shaft 34, however, is not directly attached to the linkage arms, but rather each end of the shaft is connected to the linkage arms by means of couplings 64 and 66. It is by means of these couplings that the gimbal action of the roller is accomplished. These two couplings 64 and 66 are asymmetrically placed about the shaft 34 of the roller 32 as shown in FIG. 3. As the couplings at each end of the shaft are of similar construction, focus will be given to a single coupling. To allow consistency in the use of reference numbers, the reference numbers of coupling 64 at the left end of the roller will be used.

Figure 6:
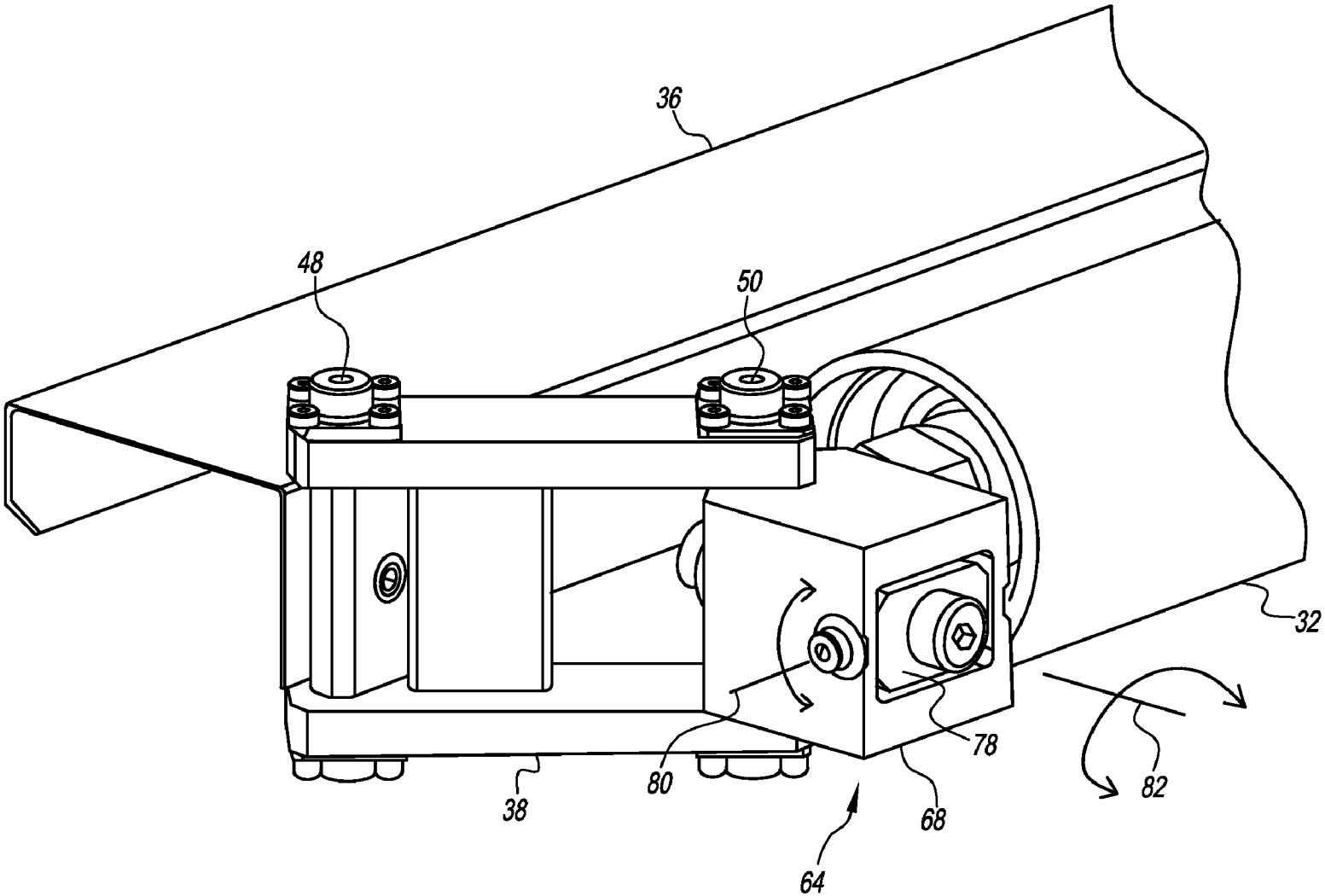
FIG. 6 is an isometric view of an example embodiment of a coupling between one end of a shaft of the roller and a link arm.
Figure 7:
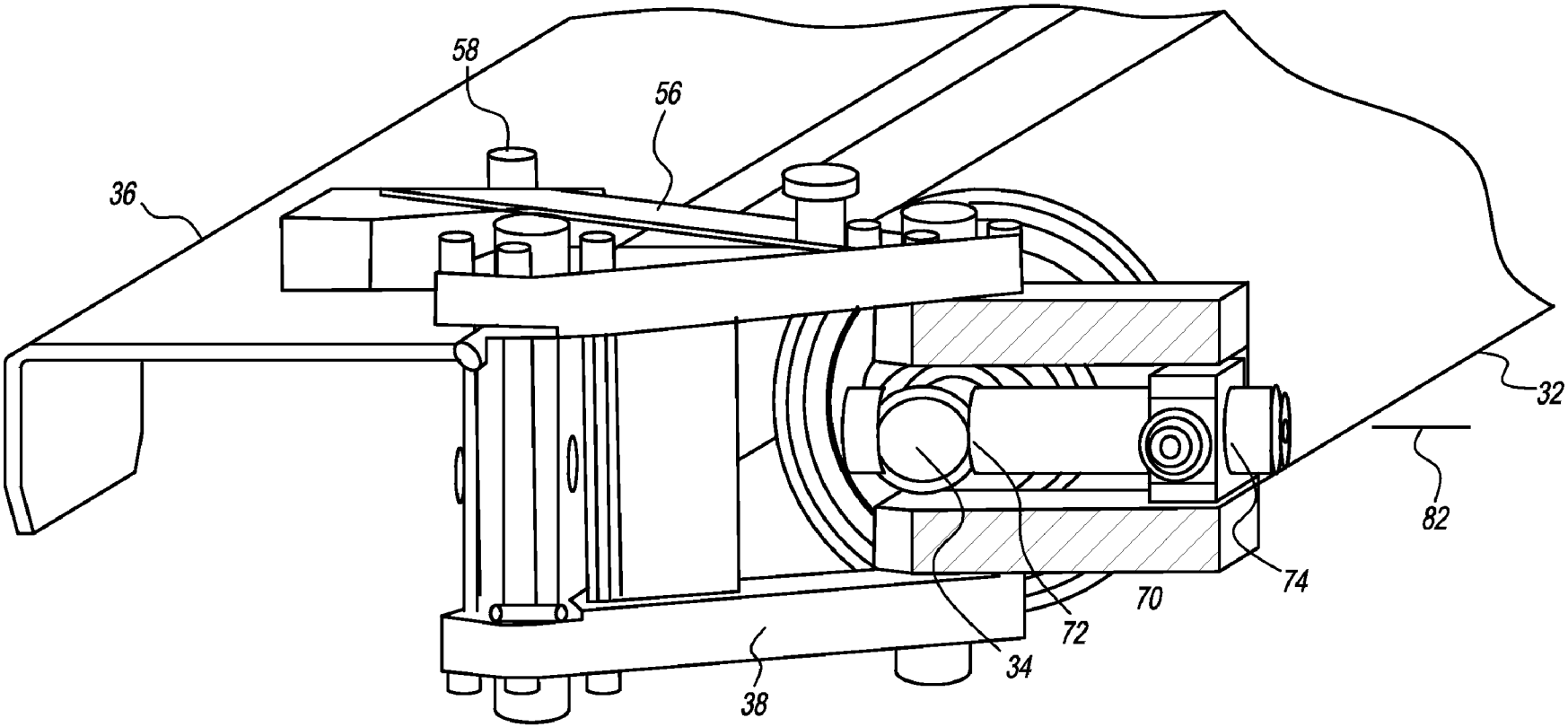
FIG. 7 is an isometric view showing a partial cutaway the coupling shown in FIG. 6.

FIG. 6 shows one embodiment of coupling 64. Coupling 64 includes a block 68 that is attached to linkage arm 38 at pivot 50. The pivot 50 allows the block 68 to rotate with respect to the linkage arm 38 about the vertical axis. FIG. 7, which is a partial cutaway view of FIG. 6, shows how the shaft is coupled to the block 68. The first end 72 of the first arm 70 being attached to the shaft 34. The first arm 70 extends from the axis of the shaft in a first direction. A first plane is defined by the axis of the shaft and the second end of the first arm. The second end 74 of the first arm is coupled to a block 68 by means of retainer 78. Retainer 78 can rotate around axis 80 relative to block 68. The first arm is free to rotate around axis 82 with respect to the shaft 34 or to the retainer 78. As a result of the freedom to rotate about axis 80 and axis 82, the block 68 is allowed to rotate with two degrees of freedom about the second end 74 of the first arm relative to the roller shaft 34.

Linkage arm 56, which limits the amount of rotation of the roller about the caster axis, is also shown in FIG. 7. Linkage arm 56 is attached to base 36 at pivot 58. The other end of the linkage arm 56 includes slot 60 through which pin 62, that is mounted to linkage arm 40, can slide. The two ends of the slot limit the rotation of the roller about the caster axis 42.

The location of the roller rotation limiting mechanism described above is suitable positioned relative to roller 32 depending on the specific application contemplated. For example, linkage arm 56 of the roller rotation limiting mechanism can be located on the left side of roller 32 (as shown in FIG. 7) or the right side of roller 32 (as shown in FIG. 5).

Figure 8:
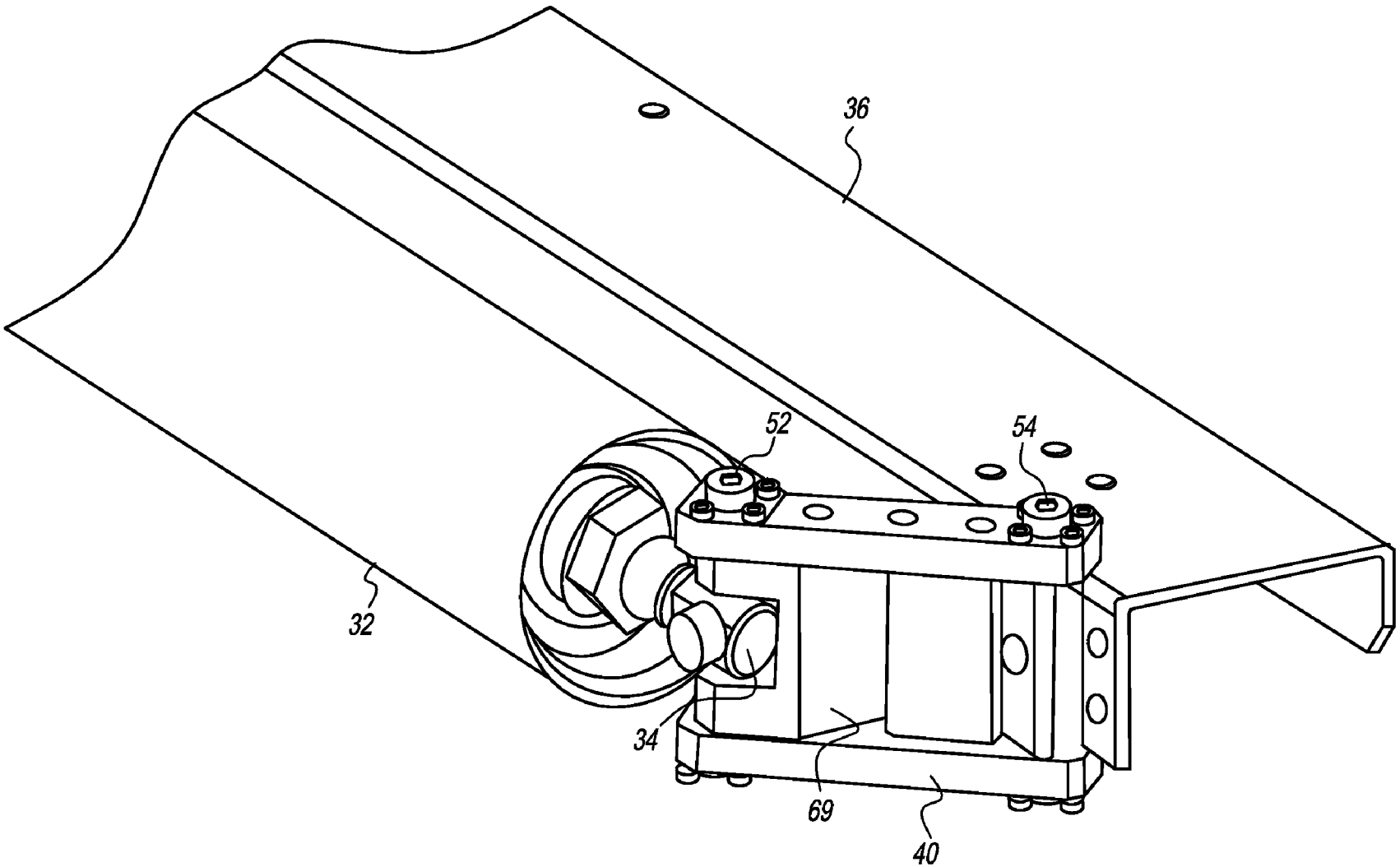
FIG. 8 is an isometric view of an example embodiment of a coupling between another end of the shaft of the roller and a link arm.

The construction at the second end of the roller shaft 34 is shown in FIG. 8. The first end 72 of the second arm 70 being attached to the shaft 34. The second arm 70 extends from the axis of the shaft in a second direction that is substantially opposite the first direction. A second plane is defined by the axis of the shaft and the second end of the second arm, the first and second planes being substantially co-planer. The second end of the second arm is coupled to block 69 by means of retainer 78. Retainer 78 can rotate around axis 80 relative to block 69. The second arm is free to rotate around axis 82 with respect to the shaft 34 or to the retainer 78. As a result of the freedom to rotate about axis 80 and axis 82, the block 69 is allowed to rotate with two degrees of freedom about the second end 74 of the second arm relative to the roller shaft 34.

The mounting of the roller 32 by means of the asymmetrically placed blocks 68 and 69 enables the roller to pivot about a rotation axis that is approximately perpendicular to the roller shaft and perpendicular to the caster axis 42. This rotation axis passes through the midpoint of the roller and serves as a gimbal axis for the roller. This is in addition to the pivoting of the roller 32 about the caster axis 42 discussed previously. It has been found however that this design is effective in balancing the tension across the width of the print media both as the print media approaches the roller and leaves the roller.

Figure 9:
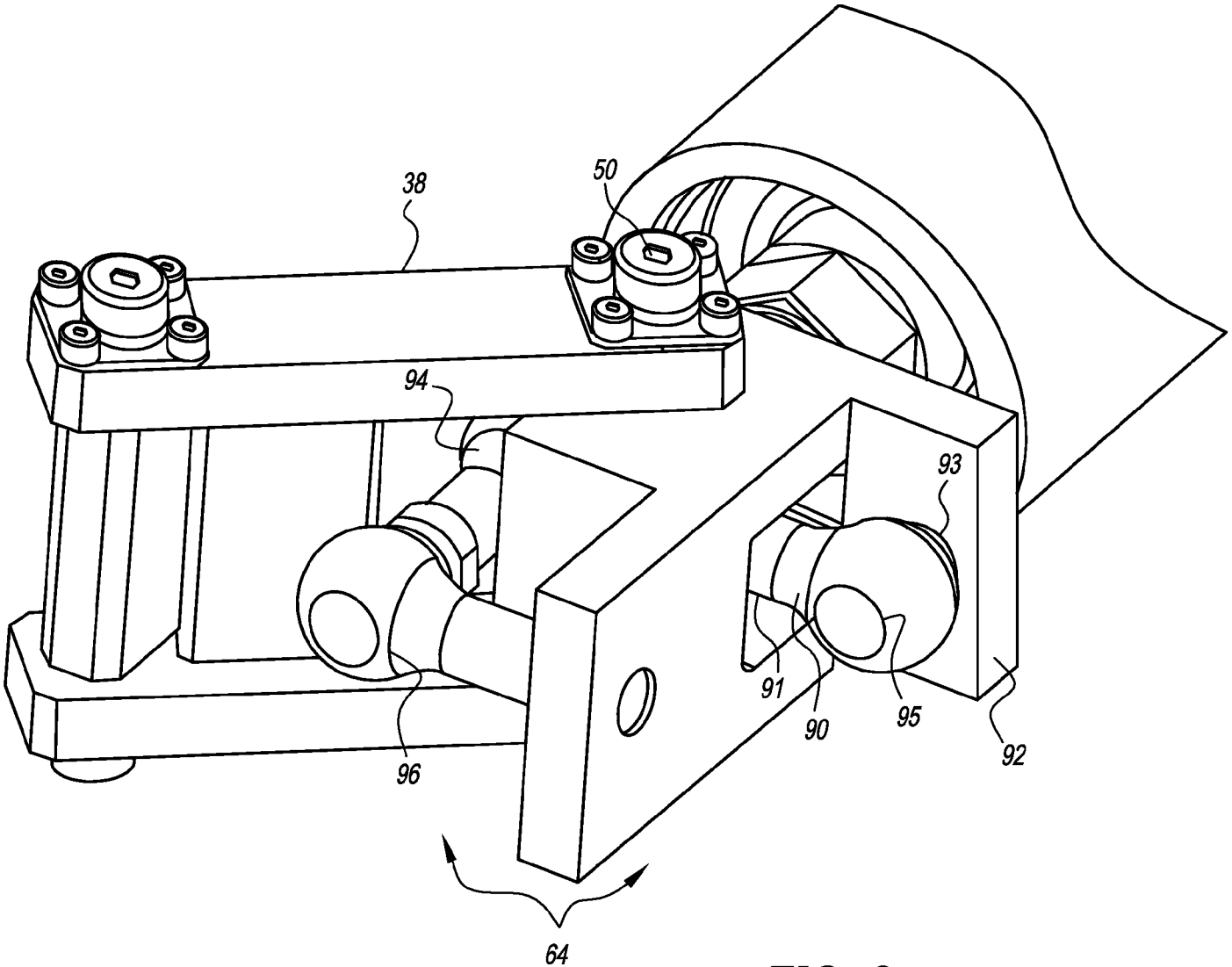
FIG. 9 is an isometric view of another example embodiment of a coupling between one end of the shaft of the roller and a link arm.
Figure 10:
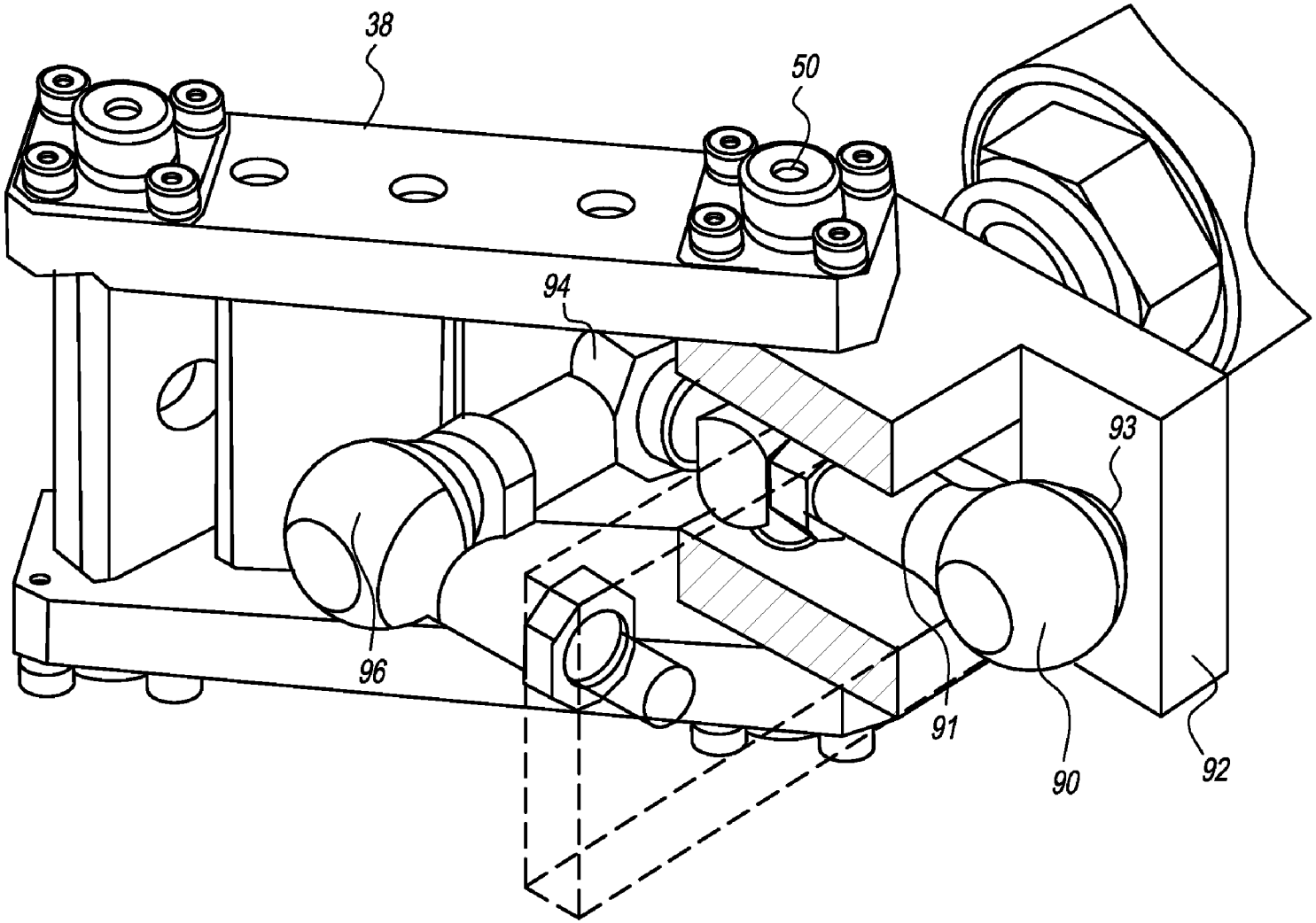
FIG. 10 is an isometric view showing a partial cutaway the coupling shown in FIG. 9.

FIGS. 9 and 10 show another embodiment of the invention. FIG. 9 is an isometric view of the mounting hardware at one end of the roller and FIG. 10 is a partial cutaway view. Instead of connecting the shaft to the block by means of the arm and the pivoting retainer to obtain two degrees of rotational freedom, this embodiment uses a set of three readily available ball joints to provide the desired two degrees of rotational freedom. Each ball joint unit includes two pieces, referred to as the arm and stem sections, that can pivot in all directions relative to the other portion by means of a ball and socket joint. To provide some descriptive clarity, the piece that includes the socket portion of the joint will be called the arm section, and the piece that includes the ball portion of the joint will be called the stem section. The naming of these portions is arbitrary and is not to be considered limiting. That is, the names of the two portions of the ball joint unit can be interchanged without a change in functionality.

Ball joint unit 90 includes an arm 91 and a stem 93. A first end of the arm 91 of ball joint 90 is secured to the end of the shaft 34. A first end of the stem 93 is secured to a block 92. The second end of the arm 91 and the second end of the stem 93 are coupled to each other by a ball and socket joint 95. The block 92 is pivotably connected to a linkage arm 38 at pivot 50. If this were the only joint between the block 92 and shaft 34, all degrees of rotational freedom would be allowed by the ball joint. Improved performance is seen once these two joints are limited to two degrees of rotational freedom.

The desired reduction in rotational degree of freedom is provided by two additional ball joints 94 and 96 that also couple the block 92 to the shaft 34. The stem of ball joint 94 is rigidly connected to the end of the shaft 34 and the arm is rigidly connected to the stem of ball joint 96. The arm of ball joint 96 is rigidly connected to the block 92. This combination of three ball joints, with two ball joints having one portion rigidly coupled to the roller shaft 34 and two ball joints having one portion rigidly coupled to the block 92, has the effect of limiting the rotation of each of the ball joints to rotation with two degrees of freedom. For each ball joint those two axes of rotation correspond to the axes that pass from that ball joint to the other two ball joints. The effect of this three ball joint combination is that the shaft 34 is coupled to the block 92 by a single two degree of freedom joint located at ball joint 94, with one axis of rotation passing through ball joints 94 and 95 and the second axis of rotation passing through ball joints 94 and 96.

In this three ball joint system, there are two degree of rotational freedom coupling between the block 92 and the shaft, with this two degree of freedom coupling being offset from the shaft by the length of the stem of the ball joint 94. The stem of ball joint 94 therefore corresponds to the arm 70 of the embodiment shown in FIGS. 6 and 7. A second three ball joint system is asymmetrically place at the other end of the shaft to produce a similar two degree of rotational freedom coupling that end of the shaft the corresponding block. The three ball joint design of FIG. 8 therefore provides an equivalent coupling between the shaft and the caster pivots as the embodiment shown in FIGS. 6 and 7.

The mount for the shaft 34, for either design, includes a first arm and a second arm, a first end of the first arm is rigidly coupled to an end of the shaft of the roller. The first arm extends away from the axis of rotation of the roller in a first direction. The shaft of the roller and the first arm lie in or define a plane. The first end of the second arm is also rigidly coupled to the opposite end of the shaft of the roller. The shaft of the roller and the second arm lie in the same plane that was defined by the shaft of the roller and the first arm. The second arm extends away from the axis of rotation of the roller in a second direction that is substantially opposite to the first direction. The second end of the first arm is coupled to a device. The coupling between the shaft and the device allows two degrees of rotational freedom about the second end of the arm, the two degrees of rotational freedom lie in the plane defined by the shaft and the first arm. In the embodiment shown in FIGS. 6 and 7, the device includes the block 68 (or the block 69). The device can also include arm 70 and retainer 78. In the embodiment shown in FIGS. 9 and 10, the device includes the block 92. The device can also include at least one of the ball joints 90, 94, 95, or 96.

Similarly, the second end of the second arm is coupled to another device. The coupling between the shaft and the second device allows two degrees of rotational freedom about the second end of the arm. The coupling between the second device and the shaft allows two degrees of rotational freedom about the second end of the arm, the two degrees of rotational freedom lie in the plane defined by the shaft and the first arm. The lengths of the first and second arm are substantially the same so that the location of the two couplings between the shaft and the first and second devices are at the same distance from the axis of rotation of the roller.

The devices, one located at the first end and one located at the second end of the roller shaft, are each being pivotably coupled to a link. The axis of rotation of this pivotal coupling between the device and the first end of the associated link is substantially perpendicular to the plane defined by the shaft and the first arm that is attached to the shaft. Each of the first link arm and the second link arm are pivotably coupled to a stationary frame at their second ends. The axes of rotation of the pivotable coupling between the link arms and the stationary frame are substantially parallel to the axes of rotation of the coupling between the link arms and the devices at each end of the roller shaft. By means of the linkage arms, the roller is allowed to pivot about an axis, that is substantially parallel to the pivot axes at the first and second ends of the link arms. This roller pivot axis is offset from the roller and it serves as the caster axis of the roller. By means of the two axis coupling between the shaft and the asymmetrically placed devices at the two ends of the shaft, the roller is free to pivot around an axis that is substantially perpendicular to the caster axis and to the shaft of the roller. This pivot axis passes through the midpoint of the roller and it serves as a gimbal axis for the roller.

When compared to a traditional caster and gimbal roller design that could be employed in a high speed printing system with print media widths in excess of 10 centimeters, the design of the present invention allows many components to be selected from an assortment of standard parts that are readily available. Additionally, the size of the non-standard components helps to reduce machining costs associated with their manufacture. Accordingly, the design of the present invention offers significant cost reduction when compared to conventional designs.

The invention has been described in detail with particular reference to certain preferred embodiments thereof, but it will be understood that variations and modifications can be effected within the scope of the invention.

PARTS LIST

10 Print media
12 Roller
14 Roller
16 Roller
18 Arrow
20 Span
22 Front Edge
24 Back Edge
26 Span
28 Caster Axis
30 Gimbal Axis
32 Roller
34 Shaft
36 Base
38 Linkage arm
40 Linkage arm
42 Caster axis
44 Extension line
46 Extension line
48 Pivot
50 Pivot
52 Pivot
54 Pivot
56 Linkage arm
58 Pivot
60 Slot
62 Pin
64 Coupling
66 Coupling
68 Block
69 Block
70 First arm
72 First end
74 Second end
78 Retainer
80 Axis
82 Axis
90 Ball joint
91 Arm
92 Block
93 Stem
94 Ball joint
95 Ball joint
96 Ball joint

The invention claimed is:

1. An apparatus for maintaining uniform tension across a width of a web, the apparatus comprising:

a roller including a shaft about which the roller rotates, the shaft defining an axis of rotation;

a first arm and a second arm each including a first end, the first end of the first arm being rigidly coupled to an end of the shaft of the roller, the first arm extending away from the axis of rotation of the roller in a first direction, the shaft of the roller and the first arm lying in a plane, the first end of the second arm being rigidly coupled to an opposite end of the shaft of the roller, the shaft of the roller and the second arm lying in the plane, the second arm extending away from the axis of rotation of the roller in a second direction that is substantially opposite to the first direction, the first arm and the second arm each including a second end;

a plurality of devices, the second end of each of the first arm and the second arm being coupled to a corresponding one of the plurality of devices at a location that is at the same distance from the axis of rotation of the roller such that each device, when considered independently of the other device, is limited to two degrees of rotational freedom about two corresponding axes of rotation relative the arm to which each device is coupled, the two degrees of rotational freedom lying within the plane; and a plurality of links, each of the devices being pivotably coupled to a corresponding one of the plurality of links, each link including a first end and a second end, the first end of each link being pivotably coupled to the shaft of the roller through the device such that a first axis of rotation is defined, the second end of each link being pivotably coupled to a stationary frame such that a second axis of rotation is defined, the first axis of rotation and the second axis of rotation being substantially parallel to each other.

2. The apparatus of claim 1, each link of the plurality of links having a length, wherein the length of each link is equivalent.

3. The apparatus of claim 1, wherein the first end of each link is aligned with the shaft of the roller.

4. The apparatus of claim 1, wherein the first end of each link includes flexure links.

5. The apparatus of claim 1, wherein the links are symmetrically positioned relative to the shaft of the roller.

6. The apparatus of claim 1, wherein the devices are asymmetrically positioned relative to the shaft of the roller.

7. The apparatus of claim 1, at least one of the devices comprising:

a block rotatably coupled to the arm of the shaft through a retainer, the block being pivotably coupled to the link.

8. The apparatus of claim 1, at least one of the devices comprising:

a block rotatably coupled to the arm of the shaft through a plurality of ball joints, the block being pivotably coupled to the link.

9. The apparatus of claim 1, further comprising:

a mechanism including structure that limits rotation of the roller about an axis, the axis being substantially parallel to at least one of the first axis and the second axis.

10. The apparatus of claim 9, wherein the structure of the mechanism comprises a linkage arm pivotably coupled to the stationary frame and slideably coupled to one of the links.

11. An apparatus for maintaining uniform tension across a width of a web, the apparatus comprising:

a roller including a shaft about which the roller rotates, the shaft defining an axis of rotation;

a first arm and a second arm coupled to opposite sides of the shaft of the roller, the shaft of the roller, the first arm, and the second arm lying in a plane, the first arm extending away from the axis of rotation of the roller in a first direction, the second arm extending away from the axis of rotation of the roller in a second direction that is substantially opposite to the first direction;

a plurality of devices, the first arm and the second arm being coupled to a corresponding one of the plurality of devices at a location that is at the same distance from the axis of rotation of the roller such that each device, when considered independently of the other device, is limited to two degrees of rotational freedom about two corresponding axes of rotation relative the arm to which each device is coupled, the two degrees of rotational freedom lying within the plane; and a plurality of links, each link being pivotably coupled to the shaft of the roller through a corresponding one of the plurality of devices such that a first axis of rotation is defined, each link being pivotably coupled to a stationary frame such that a second axis of rotation is defined, the first axis and the second axis being substantially parallel to each other.

12. The apparatus of claim 11, each of the plurality of links having a length, wherein the length of each of the plurality of links is equivalent.

13. The apparatus of claim 11, wherein a portion of each link is aligned with the shaft of the roller.

14. The apparatus of claim 11, wherein the links are symmetrically positioned relative to the shaft of the roller.

15. The apparatus of claim 11, wherein the devices are asymmetrically positioned relative to the shaft of the roller.

16. An apparatus for maintaining uniform tension across a width of a web, the apparatus comprising:

a roller including a shaft, about which the roller rotates, that defines an axis of rotation;

a first arm and a second arm coupled to opposite sides of the shaft of the roller;

a plurality of devices, the first arm and the second arm being coupled to a corresponding one of the plurality of devices at a location that is at the same distance from the axis of rotation of the roller such that each device, when considered independently of the other device, is limited to two degrees of rotational freedom about the arm to which each device is coupled; and a plurality of links, each link being pivotably coupled to the shaft of the roller through a corresponding one of the plurality of devices such that a first axis of rotation is defined, and each link being pivotably coupled to a stationary frame such that a second axis of rotation is defined.

17. The apparatus of claim 16, each of the plurality of links having a length, wherein the length of each of the plurality of links is equivalent.

18. The apparatus of claim 16, wherein a portion of each link is aligned with the shaft of the roller.

19. The apparatus of claim 16, wherein the links are symmetrically positioned relative to the shaft of the roller.

20. The apparatus of claim 16, wherein the devices are asymmetrically positioned relative to the shaft of the roller.

* * * * *